US012064000B2

(12) United States Patent
Franke et al.

(10) Patent No.: US 12,064,000 B2
(45) Date of Patent: Aug. 20, 2024

(54) SAFETY HELMET WITH MECHANICAL CODING FOR PLUG CONNECTIONS BETWEEN THE INNER LINING AND THE BEARING STRUCTURE

(71) Applicant: Dräger Safety AG & Co. KGaA, Lübeck (DE)

(72) Inventors: Katja Franke, Lübeck (DE); Jasser Rahmatyan, Lübeck (DE)

(73) Assignee: DRÄGER SAFETY AG & CO. KGAA, Lübeck (DE)

( * ) Notice: Subject to any disclaimer, the term of this patent is extended or adjusted under 35 U.S.C. 154(b) by 272 days.

(21) Appl. No.: 17/244,205

(22) Filed: Apr. 29, 2021

(65) Prior Publication Data

US 2021/0337911 A1 Nov. 4, 2021

(30) Foreign Application Priority Data

Apr. 30, 2020 (DE) ..... 10 2020 002 614.1

(51) Int. Cl.
*A42B 3/14* (2006.01)

(52) U.S. Cl.
CPC ..... *A42B 3/145* (2013.01)

(58) Field of Classification Search
CPC ..... A42B 3/145; A42B 3/14; A42B 3/0406
See application file for complete search history.

(56) References Cited

U.S. PATENT DOCUMENTS

| | | | | |
|---|---|---|---|---|
| 2,619,638 | A * | 12/1952 | Cairns | A42B 3/14 2/416 |
| 10,588,373 | B2 * | 3/2020 | Staudinger | A42B 3/08 |
| 11,304,470 | B2 * | 4/2022 | Kele | A42B 3/324 |
| 2004/0123378 | A1 * | 7/2004 | Timms | A42B 3/28 2/425 |
| 2007/0271688 | A1 * | 11/2007 | Ando | A42B 3/328 2/410 |
| 2008/0184463 | A1 * | 8/2008 | Sawabe | A42B 3/324 2/418 |
| 2009/0255036 | A1 | 10/2009 | Lim | |
| 2010/0263671 | A1 | 10/2010 | Walker et al. | |

(Continued)

FOREIGN PATENT DOCUMENTS

| | | |
|---|---|---|
| CN | 106572715 A | 4/2017 |
| DE | 1806279 U | 2/1960 |

(Continued)

*Primary Examiner* — Khaled Annis
(74) *Attorney, Agent, or Firm* — McGlew and Tuttle, P.C.

(57) ABSTRACT

A safety helmet (100) includes an arched helmet shell (1), a bearing structure (3, 4.*l*, 4.*r*, 5, 6, 8, 10), an inner lining and a plurality of connection units. The inner lining comes into contact with the head of a user of the safety helmet. The bearing structure is attached on the inside to the helmet shell. Each connection unit is capable of detachably connecting the inner lining to the bearing structure. Each connection unit comprises a bearing structure-side component and an inner lining-side component. Each component is configured as exactly one connection type. A bearing structure-side component is connectable to an inner lining-side component if the two components are configured as the same connection type. The two components cannot otherwise be connected to one another or are incapable of establishing a connection between the bearing structure and the inner lining.

16 Claims, 16 Drawing Sheets

(56) References Cited

U.S. PATENT DOCUMENTS

| | | | | |
|---|---|---|---|---|
| 2013/0212787 | A1* | 8/2013 | Pfanner | A42B 3/225 2/424 |
| 2014/0101828 | A1* | 4/2014 | Sugerman | A42B 3/145 2/418 |
| 2014/0109297 | A1* | 4/2014 | Lanez | A42B 3/04 2/411 |
| 2015/0040295 | A1* | 2/2015 | Pfanner | A42B 3/12 2/411 |
| 2015/0059057 | A1* | 3/2015 | Pfanner | A42B 3/10 2/209.3 |
| 2016/0249701 | A1* | 9/2016 | Xiong | A42B 3/085 2/421 |
| 2017/0245578 | A1* | 8/2017 | Xiong | A42B 3/147 |
| 2017/0251746 | A1 | 9/2017 | Staudinger | |
| 2017/0318888 | A1 | 11/2017 | Staudinger | |
| 2018/0271198 | A1* | 9/2018 | Ku | A42B 3/145 |
| 2019/0339736 | A1* | 11/2019 | Chang | A42B 3/145 |
| 2020/0037690 | A1* | 2/2020 | Pomering | A42B 3/08 |
| 2021/0037905 | A1* | 2/2021 | Ward | A42B 3/14 |
| 2021/0076769 | A1* | 3/2021 | Kirshon | A42B 3/121 |
| 2021/0120904 | A1* | 4/2021 | Kühnlein | A42B 3/085 |
| 2021/0337908 | A1* | 11/2021 | Pracht | A42B 3/12 |
| 2021/0337911 | A1* | 11/2021 | Franke | A42B 3/14 |
| 2022/0015488 | A1* | 1/2022 | Adams | A42B 3/063 |

FOREIGN PATENT DOCUMENTS

| | | | |
|---|---|---|---|
| DE | 8138228 | U1 | 6/1983 |
| DE | 102008047980 | A1 | 4/2010 |
| DE | 102010050678 | B3 | 4/2012 |
| DE | 102013002346 | A1 | 8/2014 |
| DE | 102013210520 | A1 | 12/2014 |
| EP | 0 184 528 | A2 | 6/1986 |
| GB | 2497371 | B | 8/2014 |
| WO | 2016019406 | A2 | 2/2016 |
| WO | 2016191789 | A1 | 12/2016 |
| WO | 2019162073 | A1 | 8/2019 |

* cited by examiner

State of the Art

SAFETY HELMET WITH MECHANICAL CODING FOR PLUG CONNECTIONS BETWEEN THE INNER LINING AND THE BEARING STRUCTURE

CROSS REFERENCE TO RELATED APPLICATIONS

This application claims the benefit of priority under 35 U.S.C. § 119 of German Application 10 2020 002 614.1, filed Apr. 30, 2020, the entire contents of which are incorporated herein by reference.

TECHNICAL FIELD

The present invention pertains to a safety helmet with an arched helmet shell made of a hard material, with a bearing structure attached to the helmet shell and with an inner lining. The bearing structure carries the inner lining. The inner lining is in contact at least partially with the scalp of the user and is manufactured at least partially from a textile and/or elastic material. The inner lining is detachably connected to the bearing structure or can be detachably connected to same.

TECHNICAL BACKGROUND

A safety helmet protects the head of the user from mechanical, thermal and/or chemical environmental effects. The user is, for example, a member of a rescue team, who rescues people from a room, said room being contaminated with fumes harmful for human beings. The safety helmet and especially the inner lining may absorb particles of harmful substances during such a mission. The safety helmet must therefore be cleaned after such a use. The inner lining comprises, as a rule, textile components and must therefore be cleaned differently from the rest of the safety helmet. It is therefore often necessary after a use to separate the inner lining from the bearing structure and to connect it again to the bearing structure after the cleaning.

SUMMARY

A basic object of the present invention is to provide a safety helmet with an arched helmet shell, with a bearing structure attached to the helmet shell on the inside and with an inner lining, which is connected or can be connected detachably to the bearing structure, the connection between the inner lining and the bearing structure being able to be established and severed again better than in the case of prior-art safety helmets.

The safety helmet according to the present invention comprises an arched helmet shell, a bearing structure, an inner lining and at least two connection units, preferably three or even more connection units.

The inner lining comes into contact at least in some areas with the head of a user of the safety helmet and can be detachably connected to the bearing structure. The inner lining preferably consists of at least one flexible and elastic material and can be washed or cleaned in another manner.

The bearing structure is attached to the helmet shell on the inside. When the inner lining is connected to the bearing structure, the bearing structure holds the inner lining.

Each connection unit comprises a respective bearing structure-side component, which belongs to (forms a part of) the bearing structure, and an inner lining-side component, which belongs to (forms a part of) the inner lining. The bearing structure-side component is connected to the helmet shell via the bearing structure.

Each bearing structure-side component belongs to exactly one connection type. Each inner lining-side component likewise belongs to exactly one connection type. The safety helmet has at least two different connection types. At least one respective bearing structure-side component and at least one inner lining-side component belong to each connection type.

A bearing structure-side component can be connected to an inner lining-side component if these two components belong to the same connection type. Two components of the same connection type are capable of establishing a detachable connection between the inner lining and the bearing structure. A bearing structure-side component of one connection type cannot be connected in one alternative to an inner lining-side component if these two components belong to two different connection types. In another alternative, these two components are incapable of establishing a permanent connection between the bearing structure and the inner lining but they become separated from one another by themselves.

The inner lining is connected according to the present invention to the bearing structure. The bearing structure carries the inner lining and holds the inner lining to a certain degree in a defined position relative to the helmet shell. The inner lining is indirectly connected to the helmet shell via the bearing structure. Therefore, and because the inner lining comes into contact with the head of a user of the safety helmet, the inner lining contributes to the helmet shell being held in a desired position on the head.

The inner lining can be detachably connected according to the present invention to the bearing structure, i.e., it can be connected to the bearing structure and can also be separated again from the bearing structure and hence from the rest of the safety helmet and be removed from the safety helmet. The inner lining separated from the rest of the safety helmet can be cleaned and cleansed separately from the rest and repaired or even completely refurbished when needed. A process of cleaning the inner lining can be tailored to the material and/or to a physical property of the inner lining.

In case of a fully established connection, the inner lining is connected to the bearing structure by means of a plurality of connection units, i.e., at a plurality of connection points. The feature that the inner lining is connected to the bearing structure at a plurality of connection points and not only at one connection point reduces the risk of the bearing structure moving by itself relative to the inner lining, while a user is wearing the safety helmet. As a result, the safety helmet is held on the head of a user more securely than if only one connection point were present. Slipping of the safety helmet is therefore prevented more reliably.

The two components of a connection unit can be connected to one another manually and they can also be separated again manually. A tool is not needed either for establishing or for separating the two components. Such a tool may not be available when needed. In addition, the use of a tool requires in many cases more time than the manual establishment or manual severing of the connection. The present invention avoids the drawbacks that would arise if a tool would have to be used to establish or sever the connection.

According to the present invention, the safety helmet has at least two different connection types. Each bearing structure-side component and each inner lining-side component belongs to exactly one respective connection type. Each connection unit, which is capable of establishing a detachable connection between the inner lining and the bearing structure, does likewise belong therefore to exactly one connection type, i.e., to one or only one connection type.

A bearing structure-side component of a connection type and an inner lining-side component of the same connection type can be detachably connected to one another. A bearing structure-side component of a snap-in connection type and an inner lining-side component of another connection type cannot be connected to one another or are unable to permanently establish a connection. This feature means that even though the two components can be connected to one another or that even through one component can be inserted into the other component, the two components can separate by themselves again from one another during a use as intended of the safety helmet. The consequence is that the two components cannot establish a stable (and permanent) connection.

According to the present invention, each connection unit belongs to exactly one connection type. At least two different connection types are distinguished from one another and they are not compatible with one another. This means that an inner lining-side component can only be connected to a fitting bearing structure-side component, i.e., only if both components belong to the same connection type. An inner lining-side component cannot be connected to a bearing structure-side component if these two components belong to two different connection types.

The at least two different connection types provide a mechanical code, since a bearing structure-side component is only compatible with an inner lining-side component if the two components belong to the same connection type. This mechanical code reduces the risk of the inner lining being connected to the bearing structure incorrectly, especially in an incorrect position. A user is, as a rule, able to recognize the mechanical code without an aid, especially without a measuring device or a tool. Compared to a coding that uses colors or other visual symbols, the mechanical coding according to the present invention can also be recognized in case of poor light conditions and in case of contamination. The mechanical coding requires no electrical or electronic components. When an attempt is made at establishing an incorrect connection between the inner lining and the bearing structure, it becomes, as a rule, obvious that the two components do not belong together. It can thus be recognized intuitively in many cases how the inner lining is to be connected correctly to the bearing structure. Time needed to train a user of the safety helmet is saved hereby.

In a first embodiment, two inner lining-side components of two different connection types differ from one another by at least one of the following parameters:

by the geometric shape, by the maximum dimension, by a dimension in a direction at right angles to the direction of the maximum dimension, or by another dimension.

In another embodiment, two bearing structure-side components of two different connection types differ from one another by at least one of these parameters.

These two embodiments may be combined with one another. The combination leads to an especially simple form of the mechanical coding.

At least one and preferably each connection unit is preferably configured to establish a respective detachable positive-locking connection between the inner lining and the bearing structure. With the positive-locking connection established, the risk is relatively low that the two components of the connection unit will separate again from one another by themselves, which would be undesirable. This positive-locking connection particularly has the form of a locking closure or snap closure.

The embodiment in which the connection unit provides a positive-locking connection avoids the drawbacks of a Velcro fastener or of a zip fastener. A Velcro fastener or a zip fastener may become contaminated or damaged. A damaged closure may not be able to assume the required function any longer. If a detachable connection were established by means of a Velcro fastener, it may, in addition, happen that a connected part is positioned incorrectly relative to the other connected part.

According to the present invention, each connection unit comprises a bearing structure-side component and an inner lining-side component. One of these two components preferably comprises a projection and the other, a recess. This especially preferably applies to each connection unit, which detachably connects the inner lining to the bearing structure. The projection can be inserted into the recess and is held in this recess, providing that the two components belong to the same connection type. If the two components belong to different connection types, the projection cannot, for example, be inserted into the recess, or the recess is too large to be able to permanently hold the projection.

Thanks to the configuration with projection and recess, all detachable connections between the inner lining and the bearing structure are established according to the same scheme. As a result, the inner lining can be connected to the bearing structure in an especially intuitive manner. This connection can in many cases also be established and severed reliably even under pressure, doing so without a tool being needed and/or under poor light conditions. The embodiment thus leads to an even higher operational reliability.

The projection of one component can be inserted into the recess of another component and is then held permanently in the recess according to this embodiment only if the two components belong to the same connection type. If the two components belong to different connection types, the projection cannot, for example, be inserted into the recess because the projection is too large, or the recess is too large, so that the recess is not capable of holding the projection in the recess.

In a first variant of this embodiment, each inner lining-side component comprises a respective projection and each bearing structure-side component comprises a respective recess. When the connection is established, the projection preferably points towards the inner side of the helmet shell. In another variant of this embodiment, each inner lining-side component comprises a respective recess and each bearing structure-side component comprises a respective projection. The projection preferably points towards the inner side of the helmet shell or is arranged in parallel to the arched surface of the helmet shell in this case as well, but it does not point towards the head of a user.

These two variants may also be combined with one another. For example, a first connection type is configured such that the inner lining-side component has a projection and the bearing structure-side component has a recess. A second connection type is configured such that the bearing structure-side component has a projection and the inner lining-side component has a recess. The projections may be geometrically identical to one another in this embodiment, and the recesses may also be identical geometrically to one another. The mechanical code is established in this case by the fact that the projection belongs to the inner lining-side component in one connection type and the projection belongs to the bearing structure-side component in the other connection type.

In one embodiment of this configuration, the projection comprises a body, a roof section (raised section) and a trunk section. The trunk section is arranged between the roof section and the body of the projection. The recess comprises a holding opening and a web. The web connects the insertion opening to the holding opening.

This embodiment makes it possible to configure the holding opening such that it has a larger cross section than the trunk section. As a result, the two components of the connection unit have a clearance relative to one another even if they belong to the same connection type and the connection is established. This effect reduces the risk of a component of the connection unit being damaged. The inner lining connected to the bearing structure can adapt itself even better to the head size and to the head shape of a user, especially because the inner lining can move to a certain degree relative to the bearing structure thanks to the clearance. On the other hand, the web of the recess prevents the connection from becoming unintentionally severed by itself.

At least one connection unit is equipped in another embodiment as follows: One component of the connection unit comprises a holding element, for example, a hook or a snap closure, as well as an insertion opening. The other component comprises a projection. The holding element of one component holds the projection of the other component when the projection is moved through the insertion opening and the detachable connection is established thereby, of course only if both components belong to the same connection type. This embodiment avoids the need for providing a web in order to hold the trunk section.

In one embodiment, the bearing structure comprises an outer component and an inner component. The designations "outer" and "inner" refer to the space that is enclosed by the arched helmet shell. The outer component is permanently connected to the helmet shell and it preferably comprises a holding ring. A distance is formed between the outer component and the head of a user of the safety helmet. The inner component is in contact with the head of a user of the safety helmet and it preferably comprises a bearing ring. The length of the bearing ring can especially preferably be changed in order to adapt the head size provided by the safety helmet to the head of a user of the safety helmet.

According to this embodiment, each bearing structure-side component is connected to the outer component. Thanks to this embodiment, the inner lining can be detachably connected to the outer component. The inner lining is connected hereby indirectly to the helmet shell. According to this embodiment, the inner lining is not connected to the inner component, so that the inner lining and the inner component can in many cases be adapted to the shape of the head of a user independently from one another. If the inner component comprises a bearing ring, whose length can be changed, the inner lining does not hinder the change in the length of the bearing ring.

In one embodiment, at least the bearing structure, the inner lining and each connection unit of a safety helmet according to the present invention are produced by at least one 3D printer. Different components of the safety helmet are optionally produced by different 3D printers, even at different locations. The helmet shell is likewise produced in one embodiment by a 3D printer, and according to another manufacturing process in another embodiment. The components are preferably assembled into a safety helmet according to the present invention.

The present invention pertains, on the one hand, to a 3D printer, which is configured to produce (print) the just mentioned components of a safety helmet according to the present invention. It is possible that these components are produced by an arrangement of 3D printers, wherein each 3D printer produces at least one respective component. On the other hand, the present invention pertains to a computer program, which can be executed on a computer. If the computer program is executed on a computer, the computer actuates at least one 3D printer. The actuated 3D printer produces the just listed components of the safety helmet according to the present invention. The computer optionally actuates a plurality of 3D printers for different components. It is also possible that different computer programs actuate a respective computer each, and each actuated computer produces a respective component of the safety helmet according to the present invention.

The present invention will be described below on the basis of exemplary embodiments. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
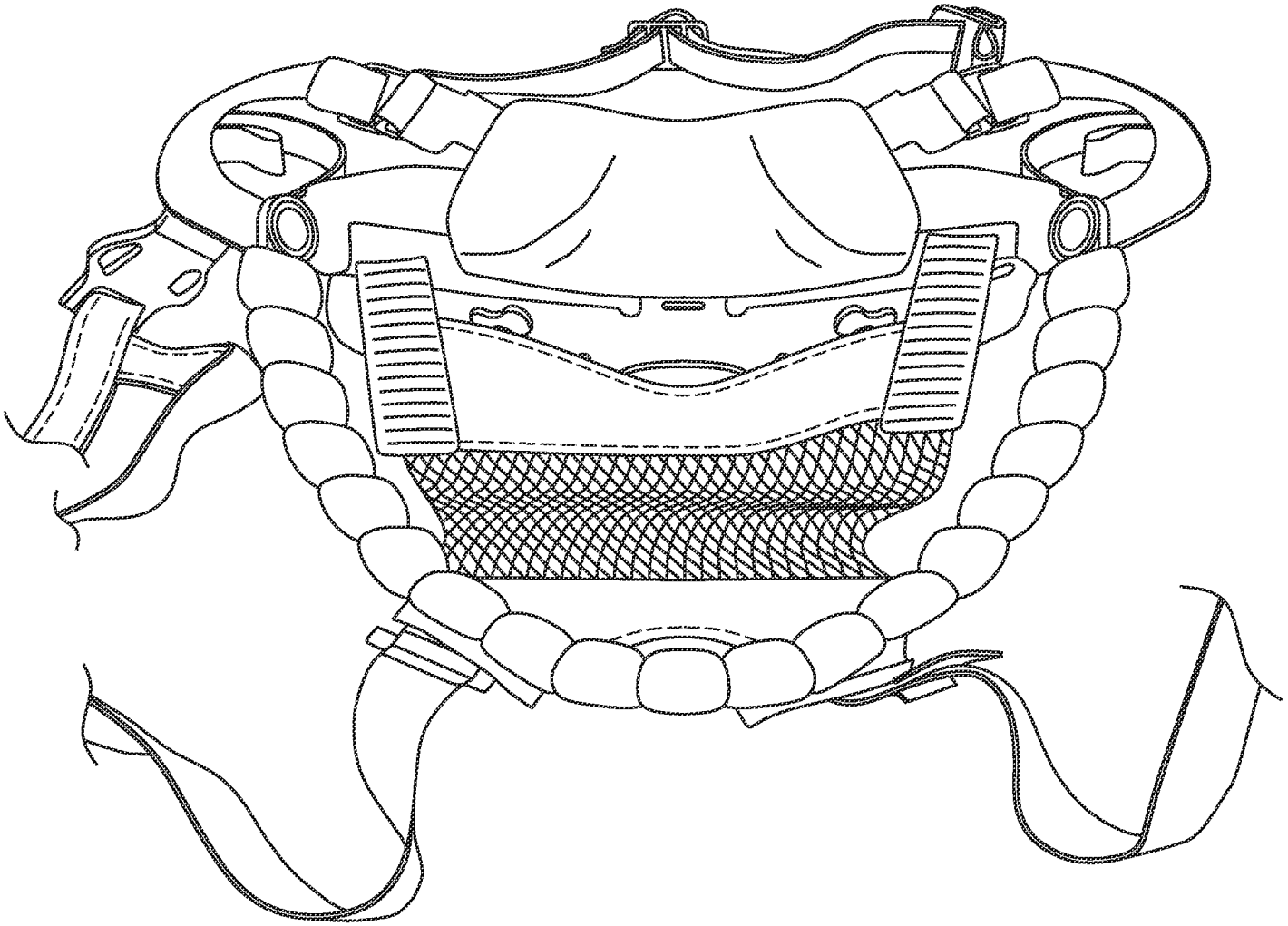
FIG. 1 is a bottom view showing an inner lining according to the state of the art.
Figure 2:
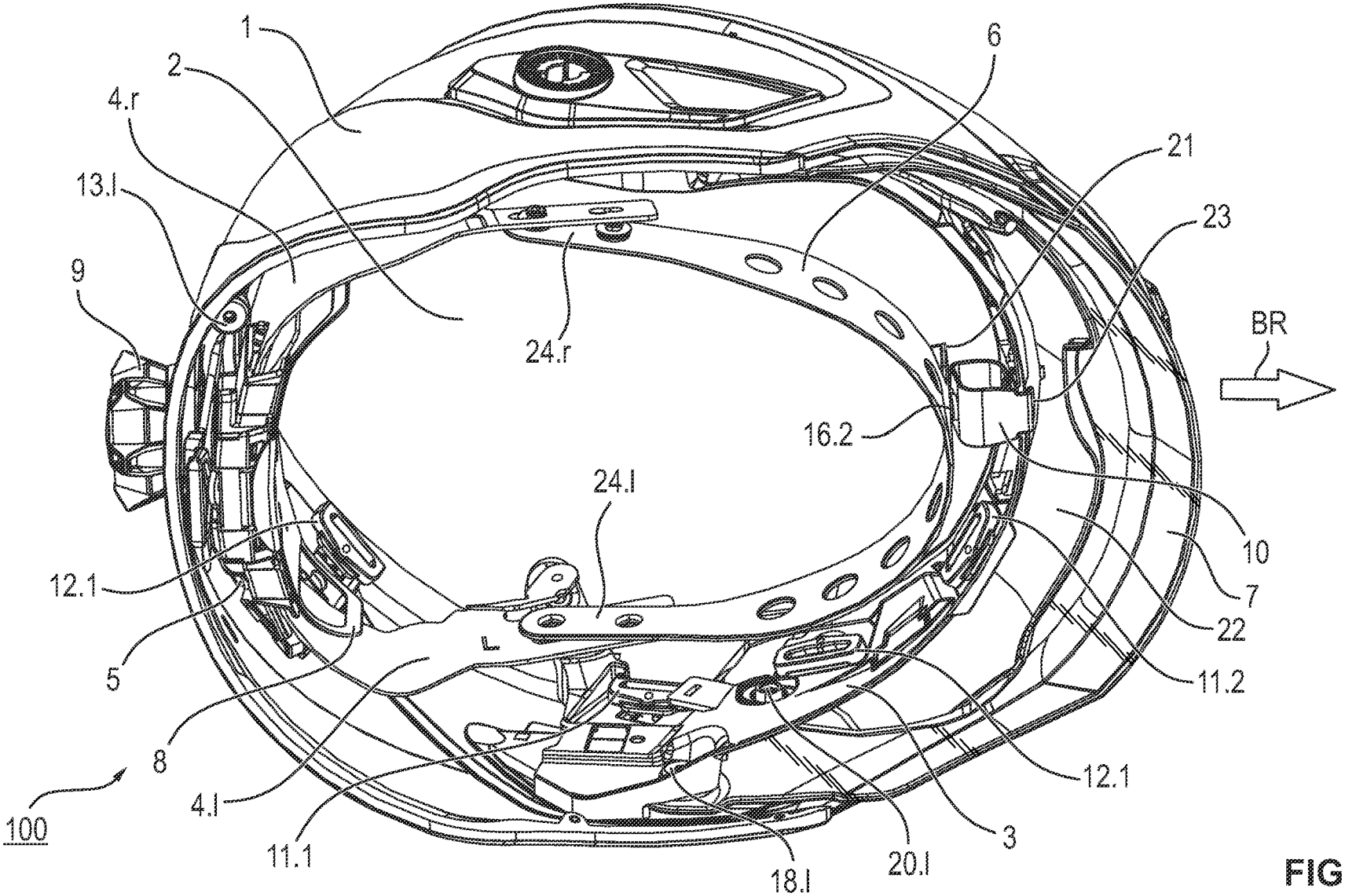
FIG. 2 is a perspective view showing a safety helmet from a first viewing direction obliquely from below.
Figure 3:
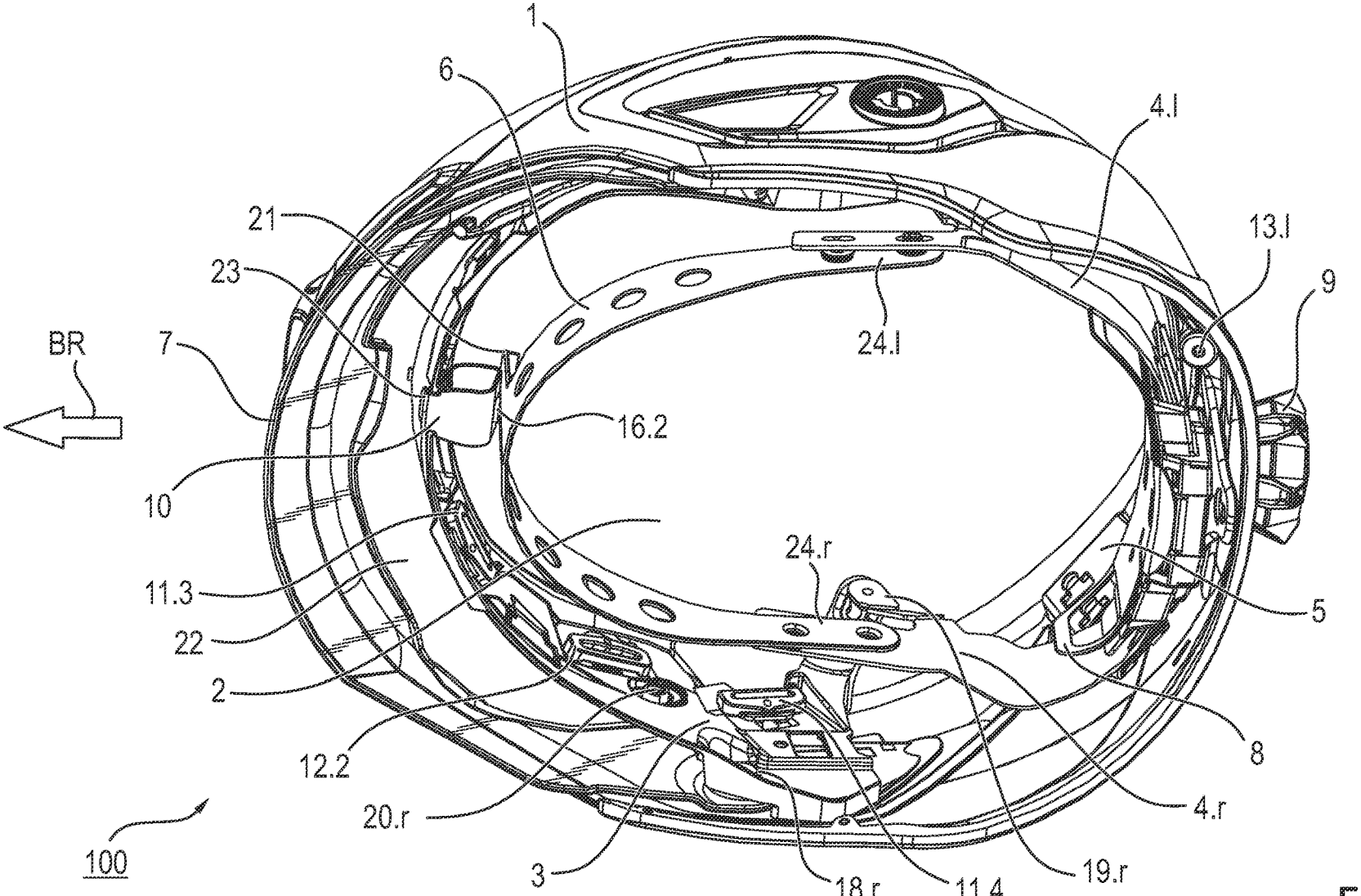
FIG. 3 is a perspective view showing the safety helmet from a second viewing direction obliquely from below.
Figure 4:
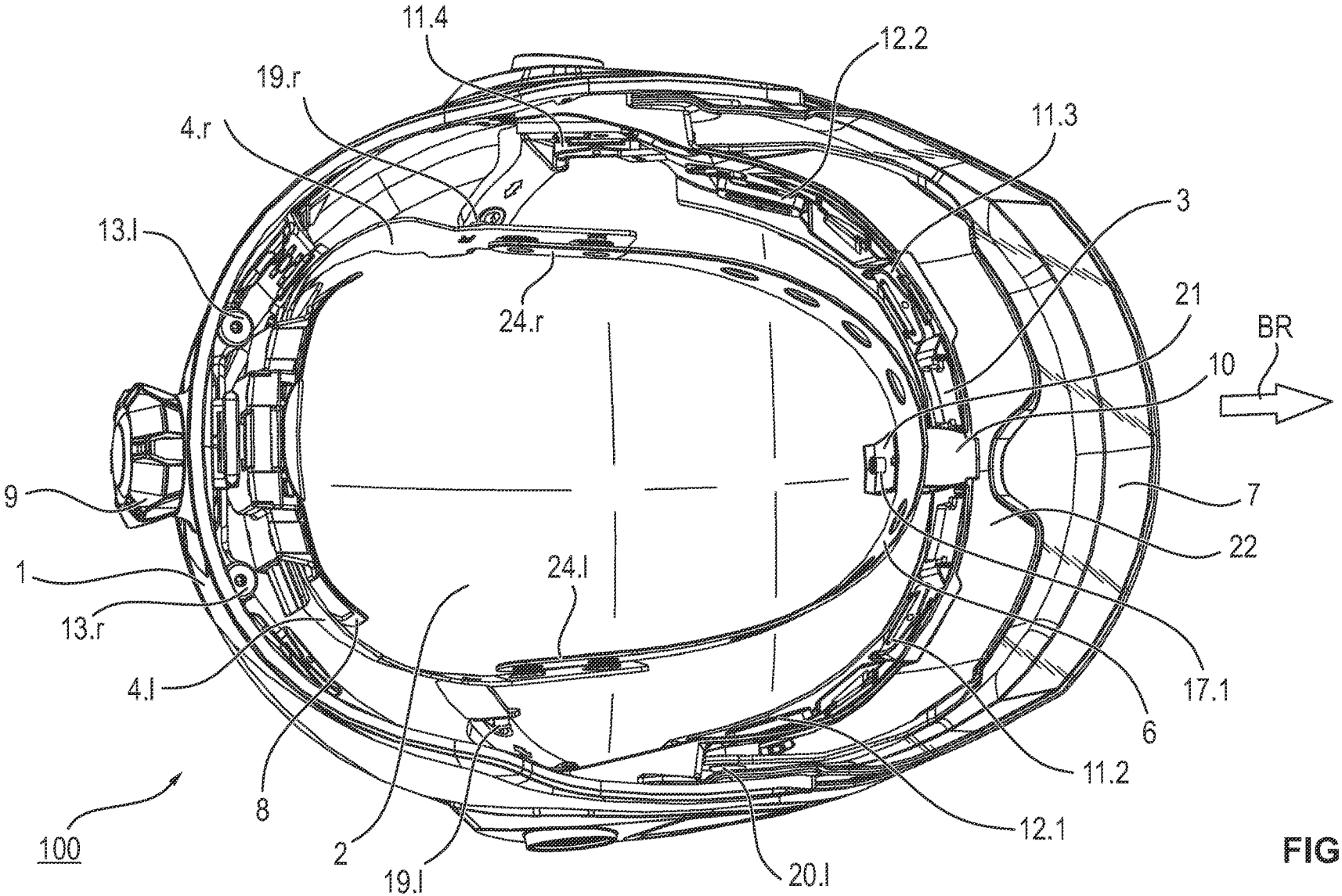
FIG. 4 is a perspective view showing the safety helmet from a viewing direction vertically from below.

Referring to the drawings, the present invention pertains to a safety helmet, which is worn by firefighters, police, rescue workers and other rescue team members on the head in order to better protect the head of the user from mechanical, thermal and chemical effects.

Just like many other safety helmets, the safety helmet according to the exemplary embodiment comprises an arched helmet shell made of a hard material, a bearing structure and an inner lining. An arched shock-absorbing shell, which absorbs kinetic energy, is optionally arranged between the helmet shell and the inner lining. The inner lining is in contact with the head of a person, who is wearing this safety helmet on his head; it contributes to holding the safety helmet on the head and is manufactured at least partially from at least one textile material, i.e., it comprises textile components. This person will hereinafter be called "the user."

The designations "left," "right," "front," "in the rear," at the top" and "at the bottom," which will be used below, pertain to the usual orientations when the safety helmet is seated on the head of the user and the user is looking horizontally forward. The bearing structure in the interior of the safety helmet connects the helmet shell to the inner lining and is manufactured from at least one solid, but elastic plastic.

In the exemplary embodiment, the bearing structure comprises

- an outer component, which is permanently connected to the helmet shell, as well as
- an inner component, which is in contact with the head of the user.

The outer component comprises a plurality of holding ring parts, which are permanently connected to the helmet shell, i.e., they are not separated from the helmet shell during the regular operation. The holding ring parts form together a circular holding ring, which is arranged on the inside at the arched helmet shell. The inner component comprises a plurality of bearing ring parts, which form together a continuous bearing ring. This bearing ring is led around the head of the user, it encloses the head fully and provides a head size, which can be changed.

Each textile component of the inner lining is detachably attached to the bearing structure. Each textile component is attached in the exemplary embodiment to the outer component, preferably at a holding ring, but not to the inner component.

When the user uses the safety helmet in an area that may be filled with gaseous harmful substances and/or particles of harmful substances, for example, in a burning or smoke-filled room, the safety helmet absorbs particles of harmful substances. The pollutant load of the textile components is, as a rule, higher than the pollutant load of other components of the safety helmet, and, in addition, these textile components come into contact with the head of the user. These textile components must therefore be cleaned and/or regularly decontaminated after each use, and this must be carried out with a process suitable for textile components, which is, as a rule, unsuitable for the rest of the safety helmet. An effective cleaning and decontamination therefore require that the textile components be removed from the safety helmet and be decontaminated in a suitable manner separately from the rest of the safety helmet, for example, in an industrial washing machine. The decontaminated textile components must then be reinserted into the safety helmet. The removal and the insertion shall require little time. The risk of a textile component being inserted incorrectly shall be reduced.

FIG. 1 shows a textile component according to the state of the art with many bands and mats and additional components, wherein the textile component forms an inner lining.

FIG. 2 through FIG. 6 show a safety helmet 100 according to the present invention. The textile components proper are omitted in these figures, while individual attaching elements for textile components of the inner lining are shown. The viewing direction BR of the user looking forward is suggested.

The safety helmet 100 comprises the following components:

- an arched helmet shell 1 made of a hard material,
- a pivotable visor 7,
- an additional visor in the form of pivotable sunglasses 22,
- an arched shock-absorbing shell 2, which is inserted into the helmet shell 1 on the inside and absorbs kinetic energy,
- a horseshoe-shaped front holding ring part 3, which is connected by two screw connections 18.*l*, 18.*r* to the helmet shell 1 and belongs to the outer component,
- a central rear holding ring part 5, which is connected by two additional screw connections 13.*l*, 13.*r* to the helmet shell 1 and likewise belongs to the outer component,
- an optional rigid intermediate piece 10 with a bent projection 23 and with a mushroom-shaped projection 17.2,
- a front bearing ring part 6, which is connected to the front holding ring part 3 directly or via an intermediary piece, which front bearing ring part 6 has a permanently mounted or rotatably mounted projection 21 and which belongs to the inner component,
- a bent left, rear bearing ring part 4.*l* and a bent right, rear bearing ring part 4.*r*, both of which belong to the inner component and are held by a bearing support 8 for the back of the head,
- the bearing support 8 for the back of the head, which is connected to the two rear bearing ring parts 4.*l* and 4.*r* and is attached to the central rear holding ring part 5,
- an inner lining, not shown, in the form of a head harness, which comprises at least one textile component and which is in contact at the top with the head of the user, and
- a rotatable handwheel 9, which is arranged on the outside at the helmet shell 1 and which the user can rotate in order to displace the two rear bearing ring parts 4.*l* and 4.*r* relative to the rear holding ring part 5 and thereby to change the head size of the safety helmet 100.

The indices .l and .r designate a left and right component, respectively.

The two rear bearing ring parts 4.*l* and 4.*r* are connected to the front bearing ring part 6 by two respective detachable snap-in connections. These two snap-in connections are established by two pairs of lateral projections 24.*l* and 24.*r* engaging (meshing) with a respective pair of corresponding lateral recesses at the two rear bearing ring parts 4.*l* and 4.*r*. The left rear bearing ring part 4.*l* is connected to the front holding ring part 3 by a snap-in connection 19.*l*, and the right rear bearing ring part 4.*r* is connected by a snap-in connection 19.*r*. The visor 7 is connected to the front holding ring part 3 by two screw connections 18.*l* and 18.*r*. The additional visor 22 is pivotably connected by two screw connections 20.*l* and 20.*r* to the front holding ring part 3. The rigid intermediate piece 10 bridges over the distance between the front bearing ring part 6 and the front holding ring part 3. The bent projection 23 of the intermediate piece 10 extends around the front holding part 3 from the bottom and from the front.

Figure 5:
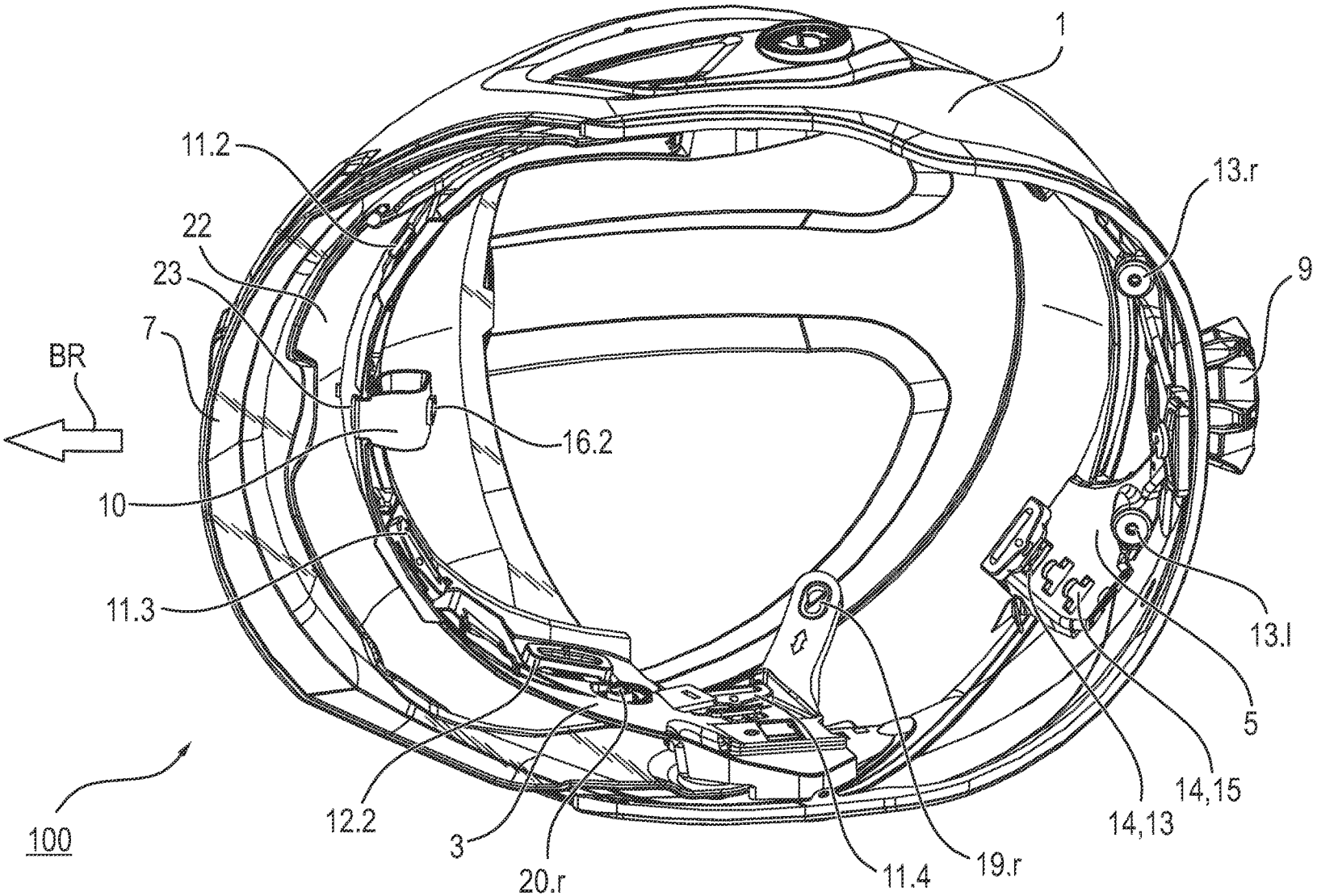
FIG. 5 is a perspective view showing the safety helmet from a third viewing direction obliquely from below, wherein the shock-absorbing shell and the bearing rings are omitted.
Figure 6:
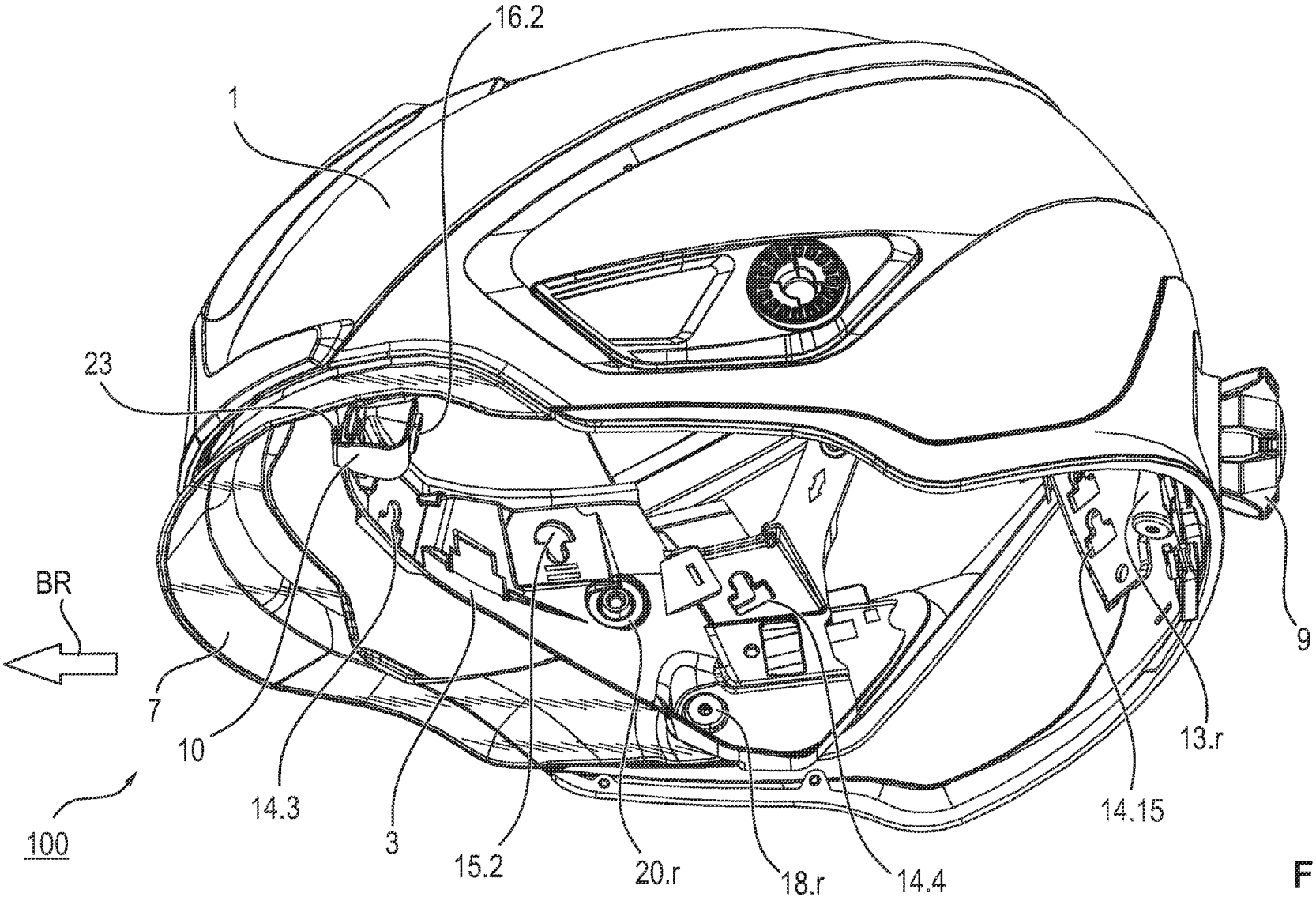
FIG. 6 is a perspective view showing the safety helmet from FIG. 5 from a fourth viewing direction from the side.

The shock-absorbing shell 2 and the bearing ring parts 4.*l*, 4.*r*, 6 are omitted in FIG. 5 and FIG. 6.

The inner lining can be detachably connected in the exemplary embodiment to the outer component of the bearing structure 3, 4.*l*, 4.*r*, 5, 6, 8, 10. The inner lining is not connected to the inner component 3, 5, so that a change in the provided head size does not affect the seating of the inner lining in the helmet shell 1. It is also possible that a textile component of the inner lining can be detachably connected to the inner component 3, 5 of the bearing structure.

The inner lining can be connected detachably to a holding ring part 3, 5 by means of a plurality of connection units in the exemplary embodiment. Each connection unit makes it possible to establish a detachable positive-locking connection between a respective textile component of the inner lining and a holding ring part 3, 5. This positive-locking connection may have the form of a snap-in connection, also called snap connection, or also the form of a snap fastener connection or toggle button connection.

Each connection unit comprises

- a bearing structure-side component, which belongs to the bearing structure, in the exemplary embodiment to a holding ring part 3 or 5, and
- an inner lining-side component, which belongs to a textile component of the inner lining.

Each bearing structure-side component has the form of an attaching element with a projection in the exemplary embodiment. Each inner lining-side component comprises a recess. With the connection established, the projection has been passed through the recess and is held in the recess, so that the projection cannot slide or slip out of the recess again by itself.

A plurality of attaching elements 11.1, 11.2, . . . of a first attaching type are shown as examples in FIG. 2 through FIG. 6. These attaching elements 11.1, 11.2, . . . of the first attaching type hold an inner lining with textile components, here in the form of a head harness, at the front holding ring part 3 and are connected to bands of this head harness. In addition, attaching elements 12.1, 12.2 of a second attaching type are shown, which are connected to another band of the head harness or of another textile component.

Figure 7:
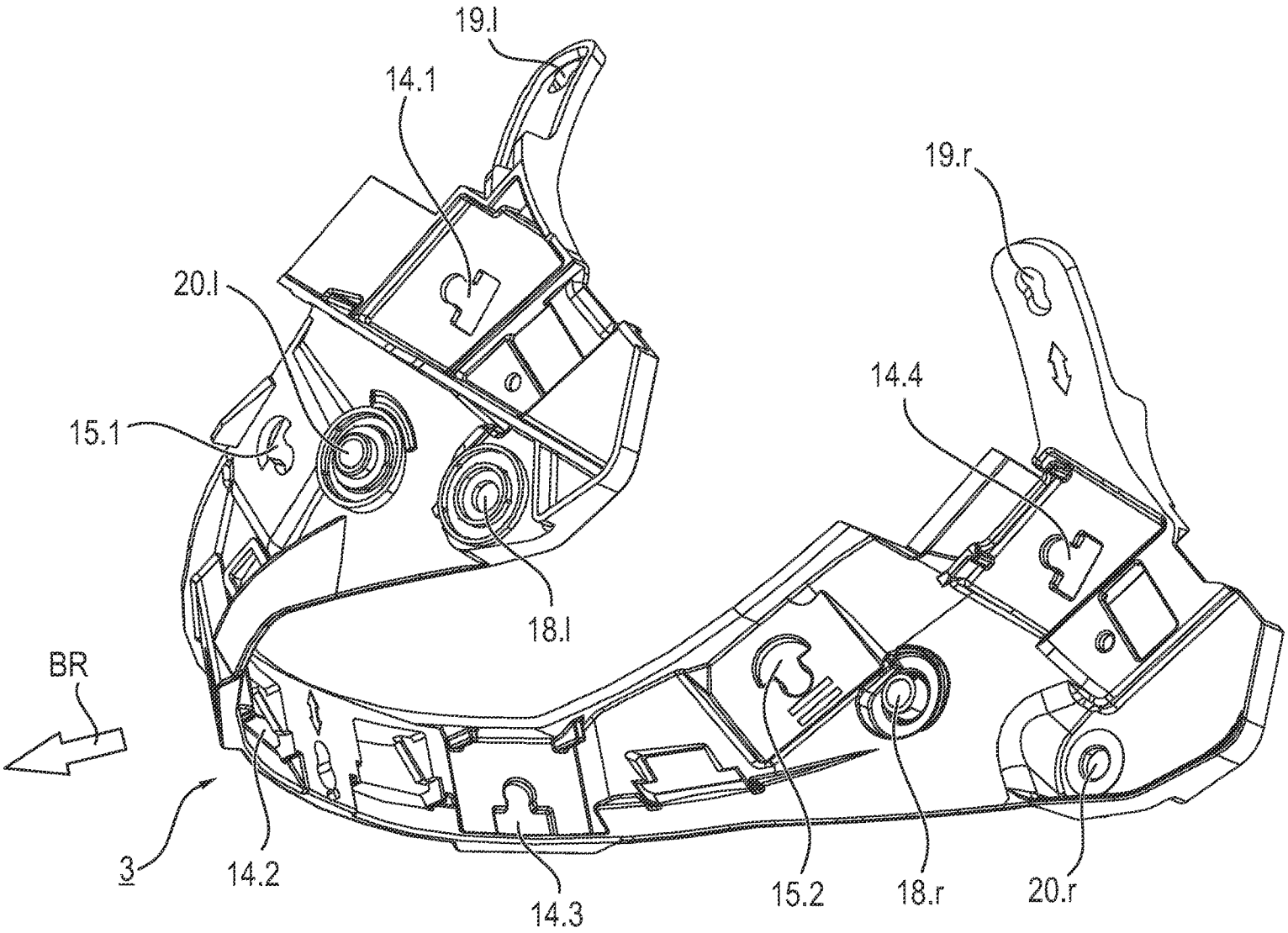
FIG. 7 is a perspective view showing the front holding ring part from a first viewing direction.
Figure 8:
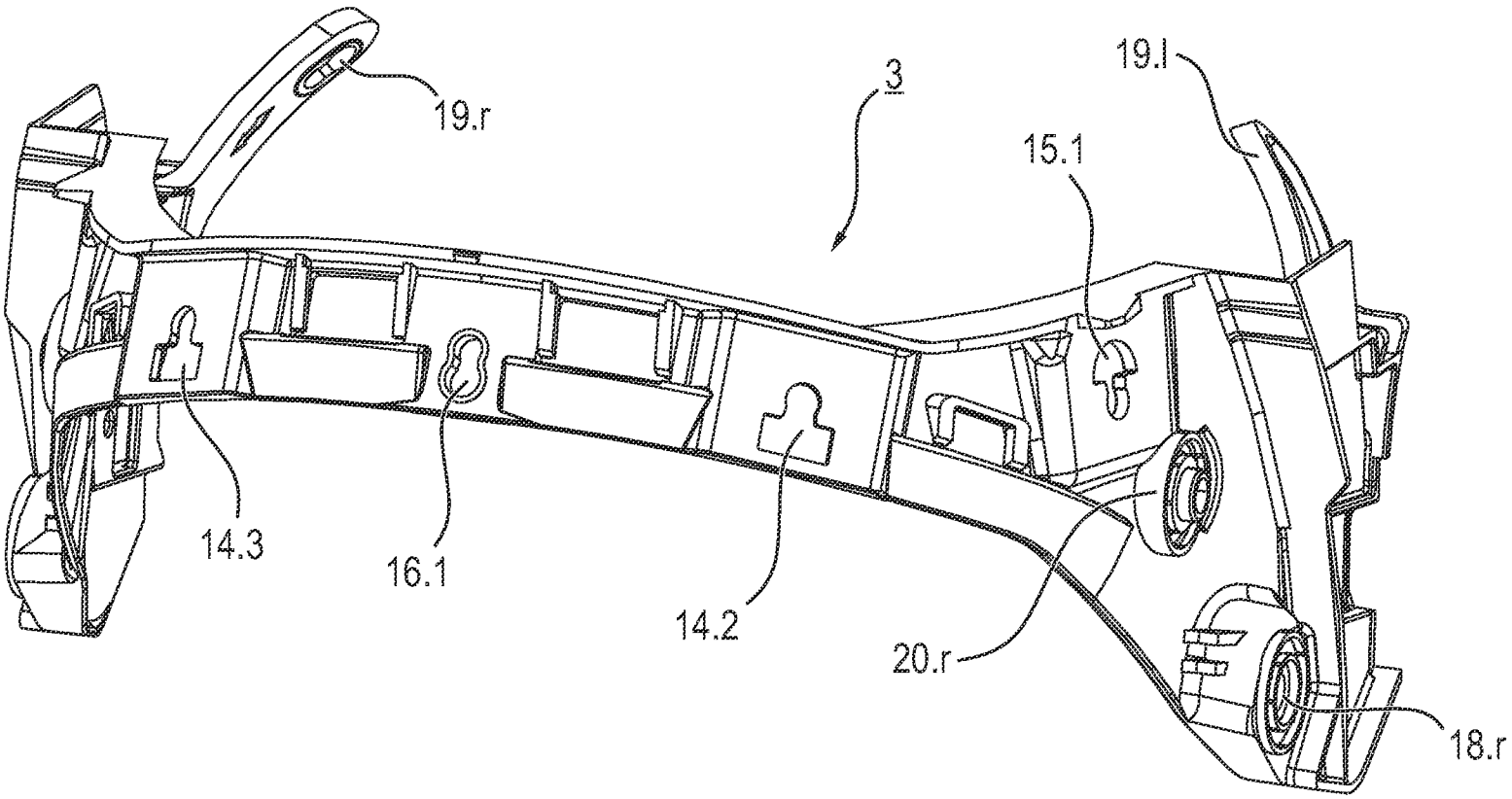
FIG. 8 is a perspective view showing the front holding ring part from a second viewing direction.
Figure 9:
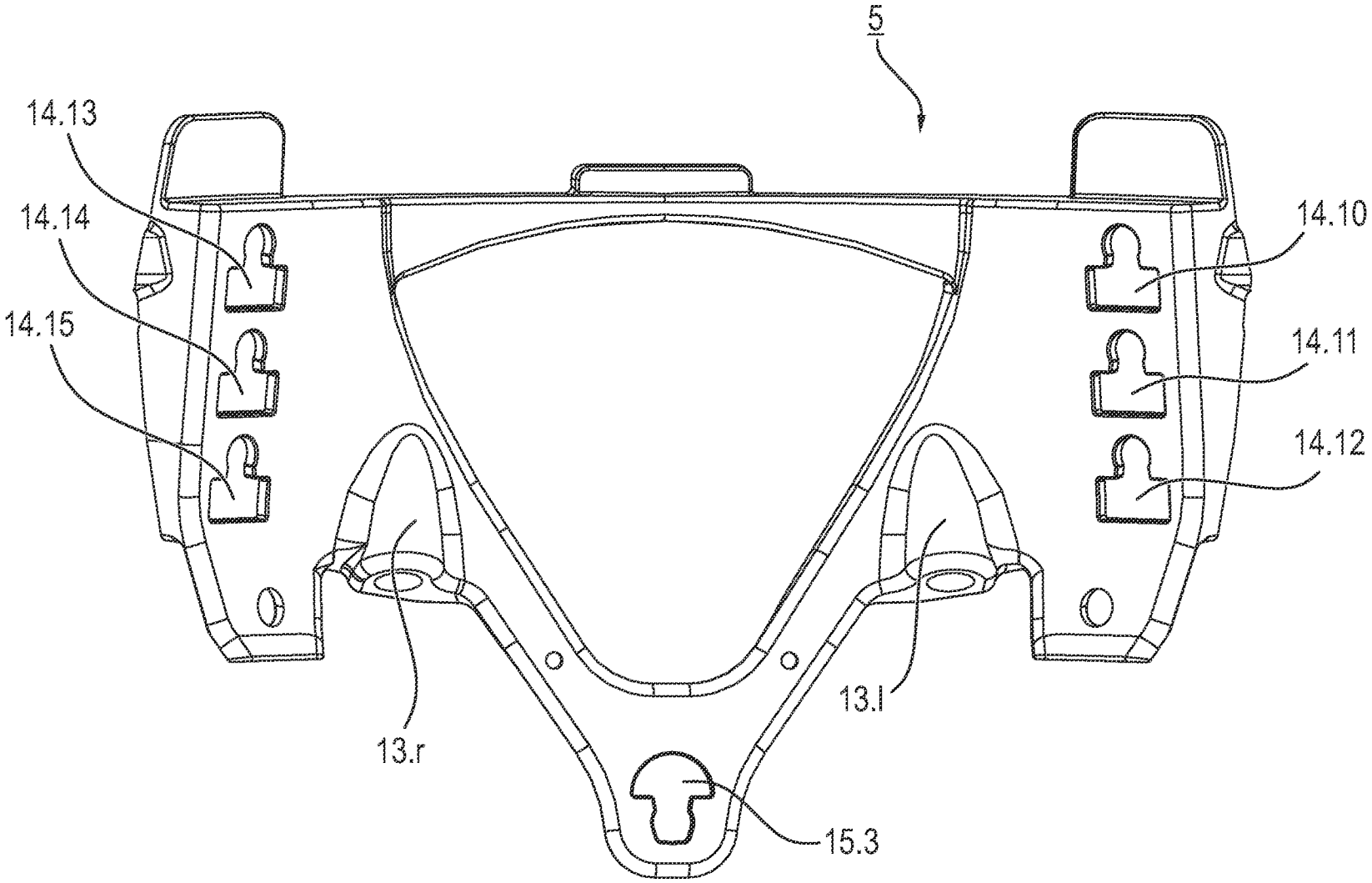
FIG. 9 is a perspective view showing the rear holding ring part.

FIG. 7 and FIG. 8 show the bent front holding ring part 3 such that the viewing direction BR points obliquely to bottom left in FIG. 7 and to the viewer in FIG. 8. FIG. 9 shows the bent rear holding ring part 5 such that the viewing direction BR points towards the viewer.

The front holding ring part 3 has a series of recesses 14.1, 14.2, . . . of a first recess type as well as a series of recesses 15.1, 15.2, . . . of a second recess type. The rear holding ring part 5 has two columns with three respective recesses 14.10, . . . , 14.15. Two corresponding attaching elements can be inserted into two recesses 14.10, . . . , 14.15 located next to one another. Three rows with two respective recesses arranged next to one another are present, and three different heights can therefore be achieved. Each recess 14.1, 14.2, . . . of the first recess type is capable of receiving and holding an attaching element 11.1, 11.2, . . . each of the first attaching type. Each recess 15.1, 15.2, . . . of the second attaching type is capable of receiving and holding a respective attaching element 12.1, 12.2, . . . of the second attaching type.

The first attaching type and the first recess type form together a first connection type. The second attaching type and the second recess type form together a second connection type.

Figure 10:
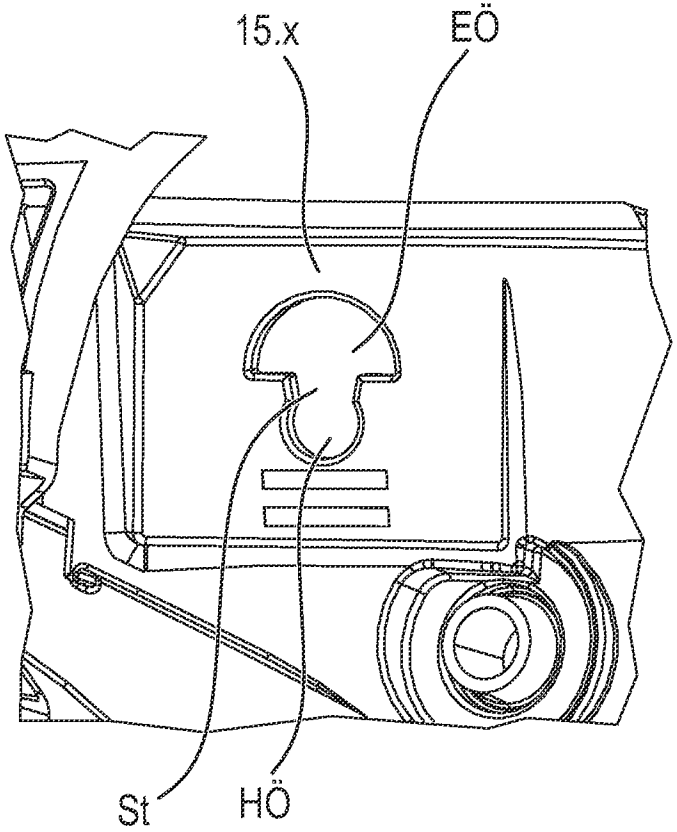
FIG. 10 is a perspective view showing a recess of the first recess type and a recess of the second recess type.
Figure 10:
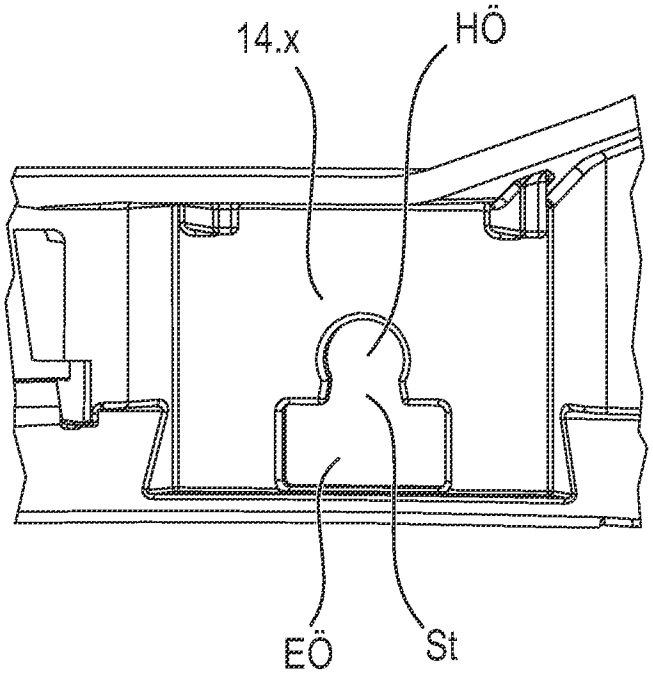

FIG. 10 shows an exemplary recess 14.*x* of the first recess type and an exemplary recess 15.*x* of the second recess type. Each recess 14.*x*, 15.*x* has a respective insertion opening EÖ, a holding opening HO and a web St between the insertion opening EÖ and the holding opening HÖ.

Figure 11:
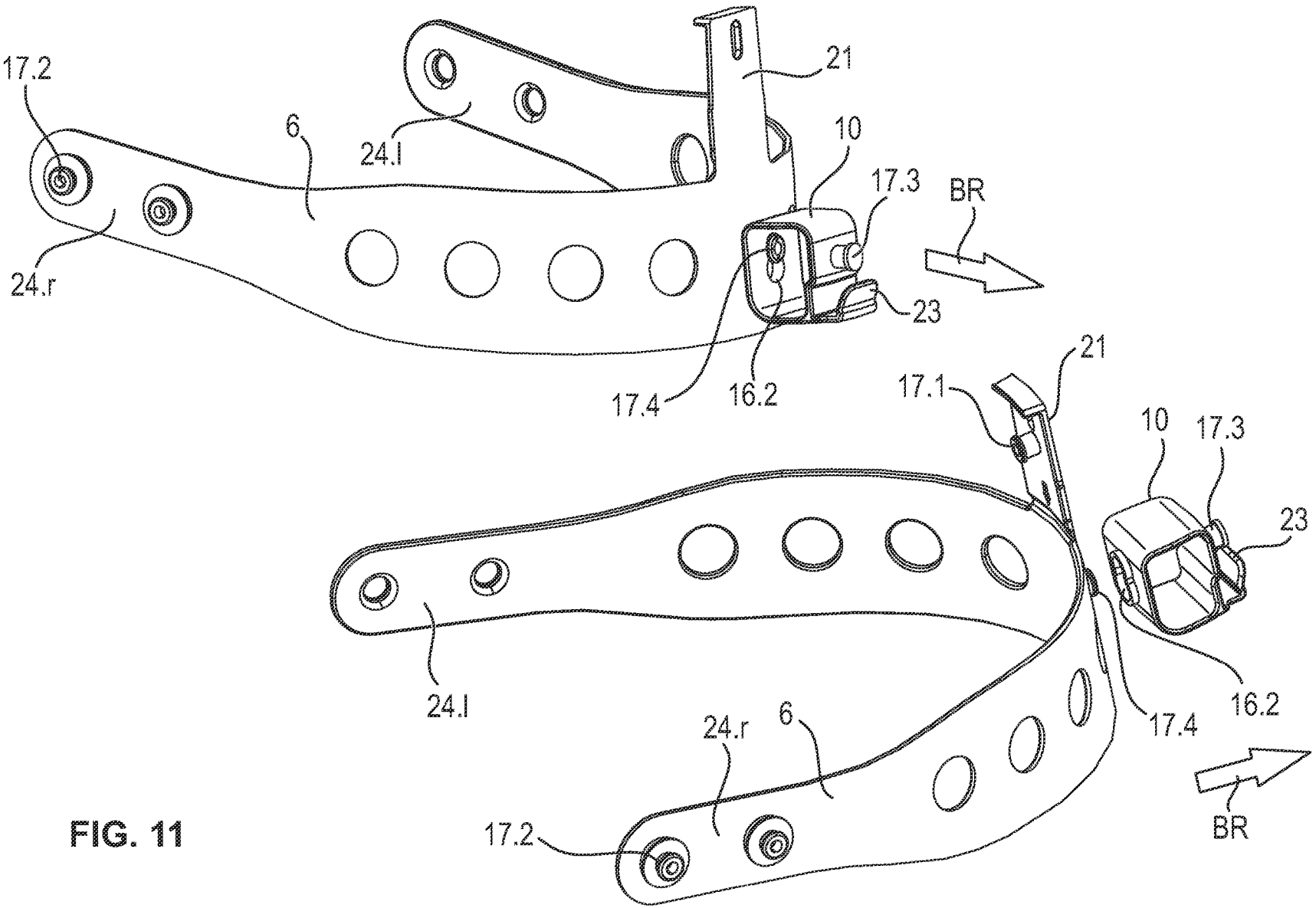
FIG. 11 is a perspective view showing the front bearing ring part and the intermediate piece in a first viewing direction.
Figure 12:
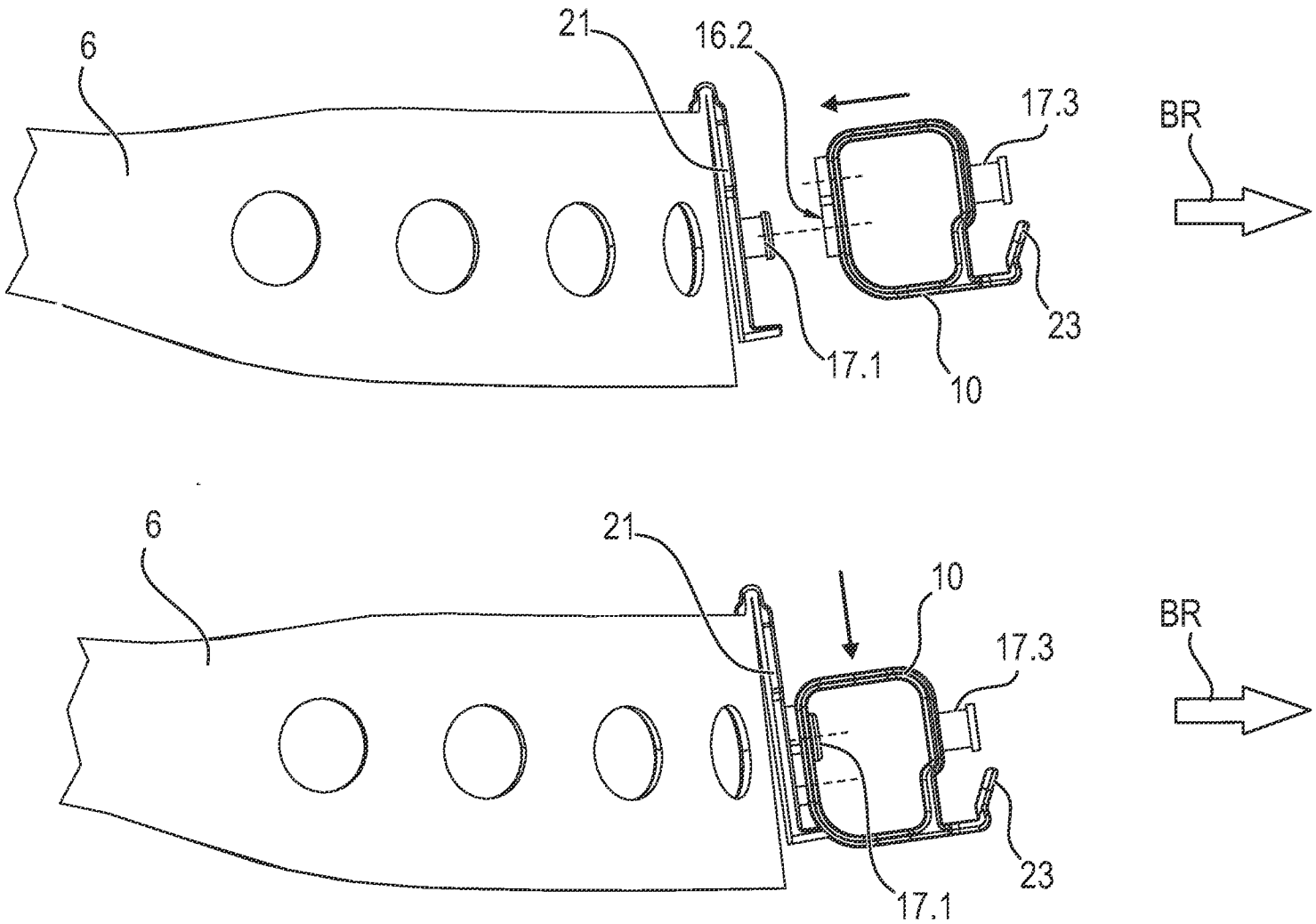
FIG. 12 is a perspective view showing the front bearing ring part and the intermediate piece in a second viewing direction.

FIG. 11 and FIG. 12 show the front bearing ring part 6 with the upwards pointing projection 21 and the rigid intermediate piece 10 with the bent projection 23 in two perspective views from two different viewing directions. A mushroom-shaped attaching element 17.1 is located at the projection 21. A hole 16.2 is formed in the intermediate piece 10. The top part of FIG. 11 shows an embodiment in which the intermediate piece 10 is permanently connected to the projection 21 and the attaching element 17.1 points rearwards. FIG. 11 and FIG. 12 show an alternative embodiment, in which the projection 21 is rotatable about a horizontal axis relative to the front bearing ring part 6. If the projection 21 is folded down, the attaching element 17.1 points forward. The intermediate piece 10 can be attached onto the attaching element 17.1 such that the attaching element 17.1 passes through the recess 16.2.

Figure 13:
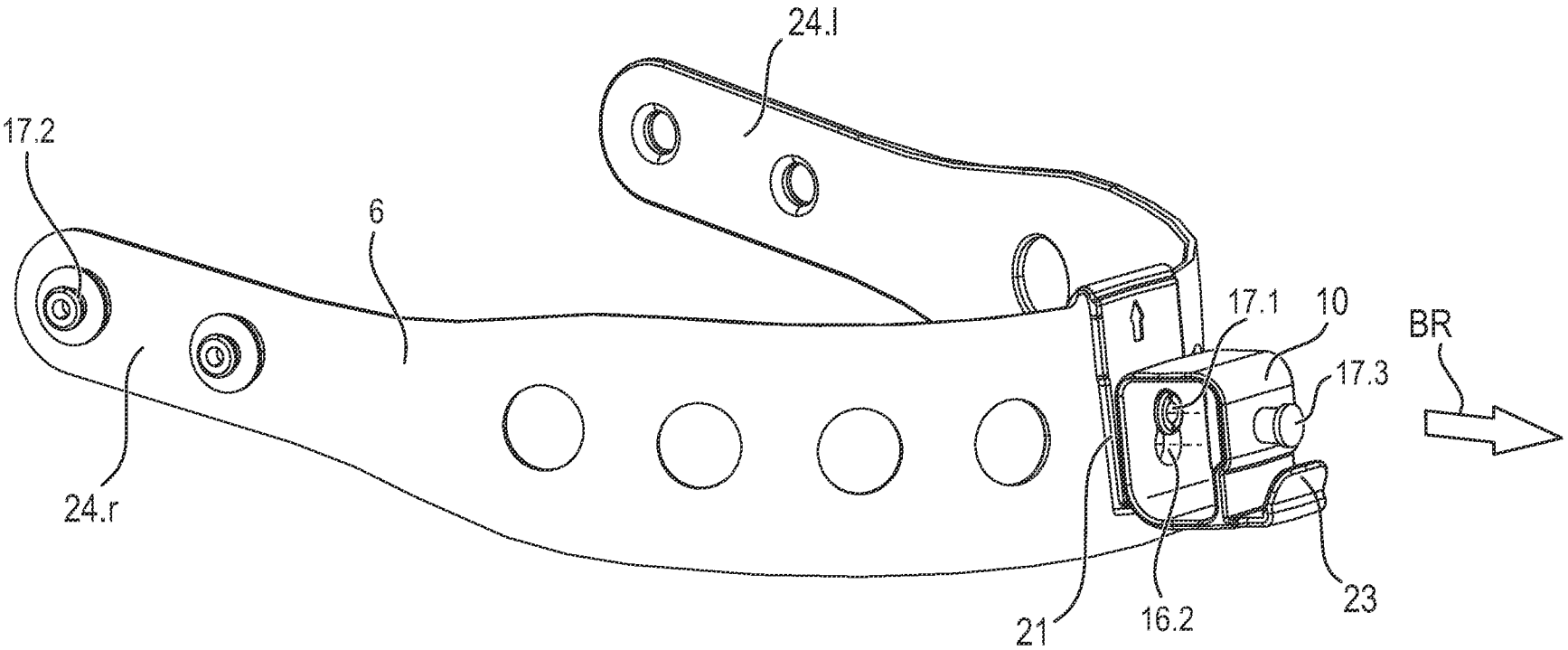
FIG. 13 is a perspective view showing the front bearing ring part and the intermediate part in a third viewing direction wherein the projection is moved downwards.
Figure 14:
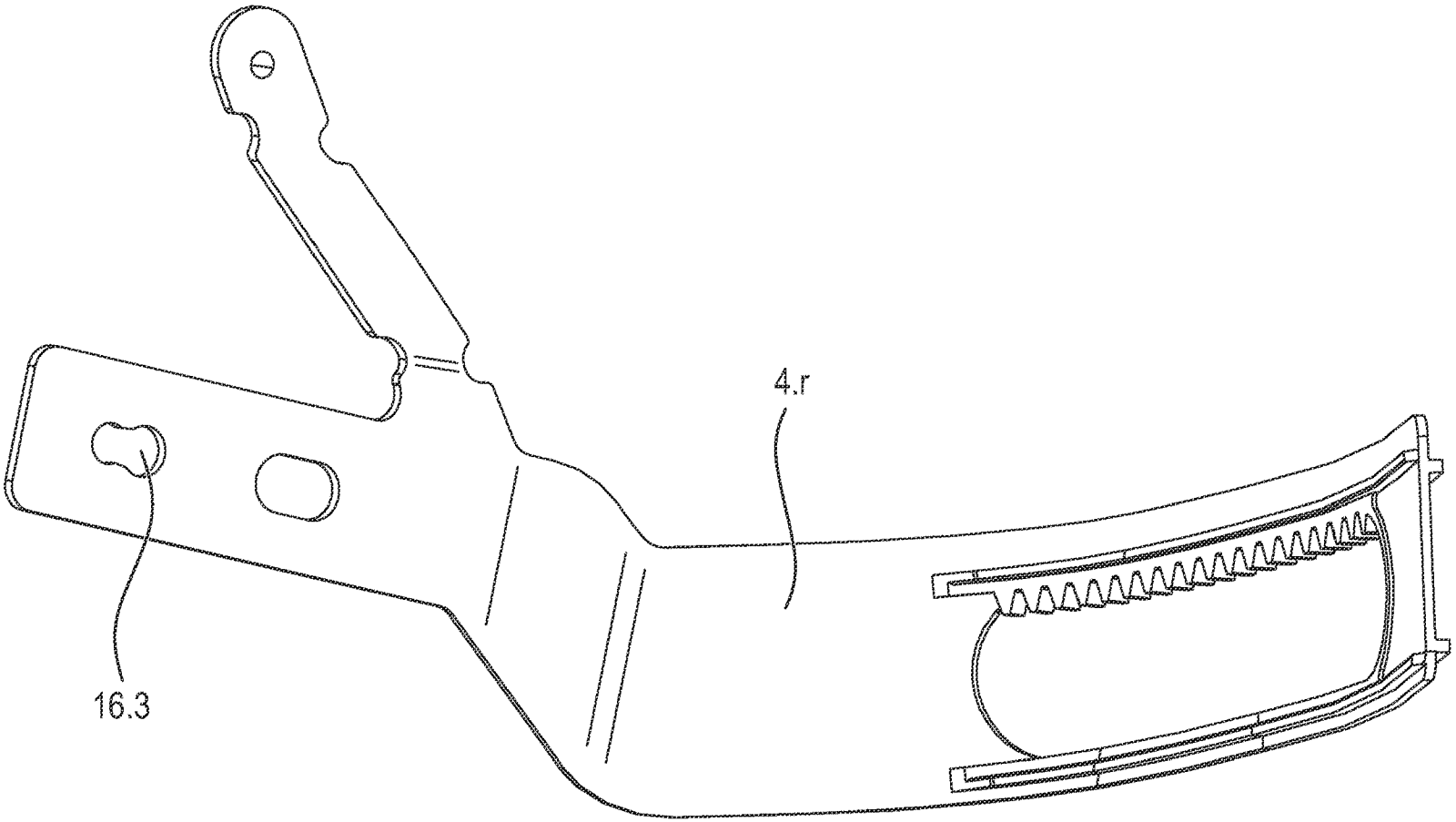
FIG. 14 is a perspective view showing the right rear bearing ring.

FIG. 14 shows the right rear bearing ring part 4.*r*. Attaching elements 17.1, 17.2, . . . of a third attaching type and a recess 16.2 of a third recess type can be seen in FIGS. 11 and 13 (recess 16.1 of the third recess type is shown in FIG. 8). Each recess 16.1, 16.2 of the third recess type is capable of receiving a respective attaching element 17.1, 17.2, . . . of a third attaching type. The attaching element 17.1 is attached to the projection 21.

Note: The attaching elements 17.2 fasten the bearing ring part 6 at corresponding recesses in a holding ring part 4.*l*, 4.*r*. Attaching elements and recesses for fastening the inner lining to the bearing structure may have exactly the same configuration.

Figure 15:
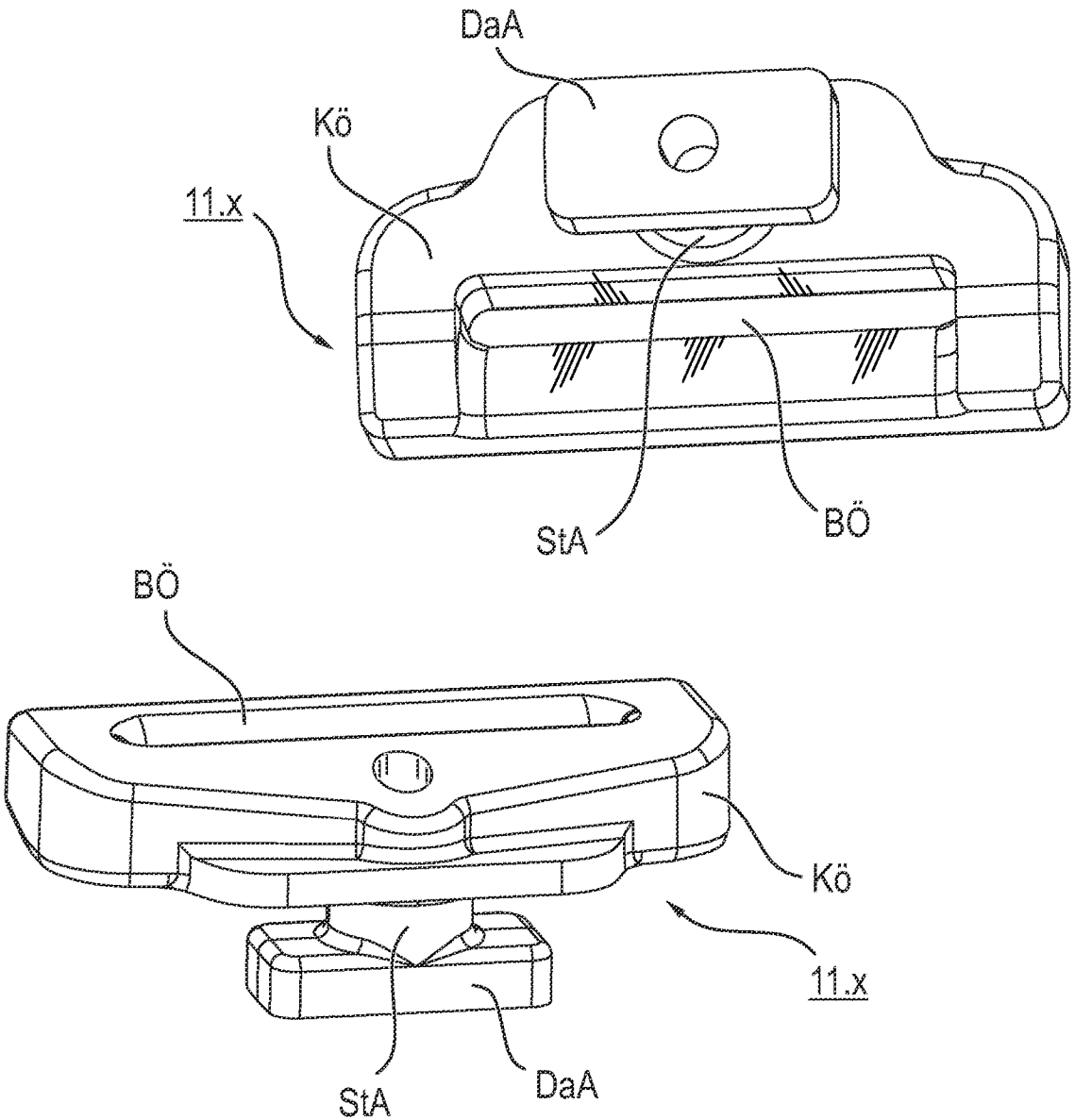
FIG. 15 is a perspective view showing an attaching element of the first attaching type from two different viewing directions.
Figure 16:
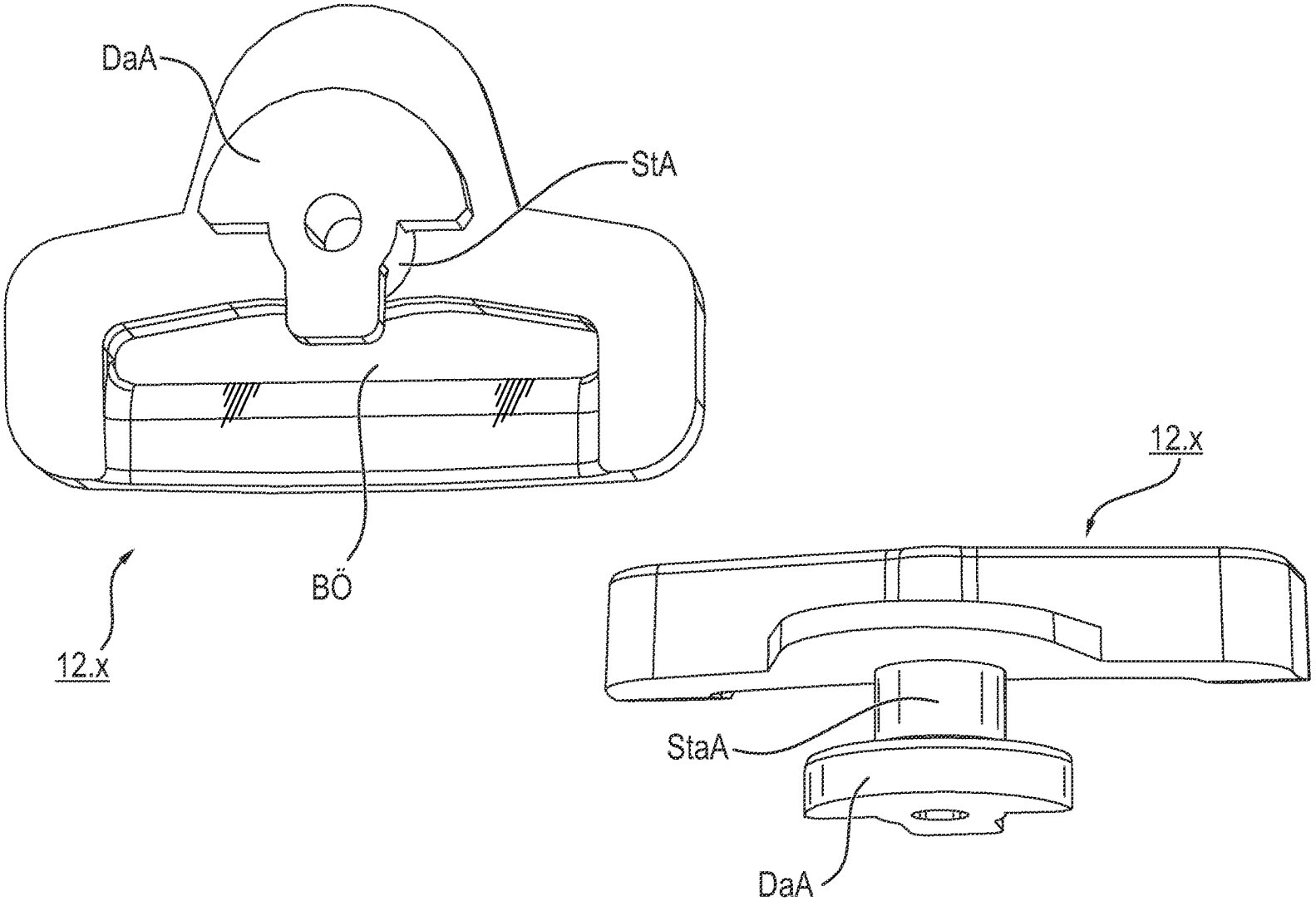
FIG. 16 is a perspective view showing an attaching element of the second attaching type from two different viewing directions.

FIG. 15 shows an exemplary attaching element 11.*x* of the first attaching type from two different viewing directions. FIG. 16 shows an exemplary attaching element 12.*x* of the second attaching type from two different viewing directions. Each attaching element 11.*x*, 12.*x*, 17.*x* comprises each

- an attaching element body Kö,
- a band opening BO in the attaching element body Kö, through which a textile band can be pulled in order to attach the attaching element 11.*x*, 12.*x*, 17.*x* to the band,
- a roof section DaA and
- a trunk section StA between the roof section DaA and the attaching element body Kö.

The roof section DaA projects over the trunk section StA in each direction and is flatly connected to the trunk section StA.

An attaching element 11.*x*, 12.*x*, 17.*x* is connected detachably to a receiving component, for example, to a holding ring part 2, 5 or to a bearing ring part 4.*l*, 4.*r*, 6 as follows, as a result of which a detachable positive-locking connection is established:

- the roof section DaA is pushed through the insertion opening EO in an insertion direction, and
- the attaching element 11.*x*, 12.*x*, 17.*x* is pushed through the web St towards the holding opening HO in a holding direction until the trunk section StA is fully enclosed by the holding opening HO. The holding direction is positioned vertically or obliquely to the insertion direction.

The receiving component is manufactured from a reversibly deformable material, entirely or at least in the area that encloses the web St. The width of the trunk section StA is greater than the width of the web St, so that the trunk section StA deforms the web St reversibly during the insertion. The trunk section StA cannot slide back to the insertion opening Eö through the web St by itself because of the greater width. By contrast, a gap is formed between the circumference of the trunk section StA and the edge of the holding opening HO, so that the attaching element 11.*x*, 12.*x*, 17.*x* can rotate relative to the receiving component.

An attaching element 11.*x*, 12.*x*, 17.*x* provides an inner lining-side component. The insertion opening Eö, the holding opening HO and the web St belong to a recess 14.*x*, 15.*x*, 16.*x*, which provides a corresponding bearing structure-side component. An attaching element 11.*x*, 12.*x*, 17.*x* can consequently be inserted into a fitting recess 14.*x*, 15.*x*, 16.*x* and it then forms a detachable positive-locking connection.

The attaching elements 11.*x*, 12.*x*, 17.*x* belong in this embodiment to a respective inner lining-side component, and the recesses 14.*x*, 15.*x*, 16.*x* belong each to a bearing structure-side component. In another embodiment, each bearing structure-side component comprises a respective holding element for the attaching element, e.g., a clamp or a clip, but not necessarily a web and not necessarily a trunk section. The attaching element 11.*x*, 12.*x*, 17.*x* is pushed through the insertion opening Eö and is held by means of the holding element. The detachable positive-locking connection is established in this manner in this other embodiment.

The attaching elements of one attaching type have all the same geometric shape and the same dimensions, at least in a plane at right angles to the insertion direction. By contrast, the attaching elements of two different attaching types differ in the exemplary embodiment by their geometric shapes and/or by at least one dimension, at least in the plane at right angles to the insertion direction. The recesses of a recess type correspondingly have all the same geometric shape and the same dimensions in the plane in which the recess extends. The recesses of two different recess types differ from one another by their geometric shapes and/or by at least one dimension. Each attaching type is associated with exactly one recess type. An attaching element 11.*x*, 12.*x*, 17.*x* can be inserted into a recess 14.*x*, 15.*x*, 16.*x* of the associated recess type and be held there, without it being able to slide out again by itself.

The different attaching types and the different recess types thus provide a mechanical code. In other words, each attaching type is compatible with exactly one recess type and vice versa, each recess type is compatible with exactly one attaching type. It is not possible in some non-compatible combinations of attaching element and recess to insert without destruction an attaching element into a recess of a recess type, which is incorrect because it is not associated, because the recess is too small. In other possible combinations an incorrect recess is so large that the attaching element falls or slips out of the recess by itself, i.e., it is not capable of establishing a permanent connection and it does not therefore obviously match the recess. The present invention thus reduces the risk of an inner lining being arranged incorrectly in the interior of the safety helmet 100 after a cleaning or a replacement.

Independently from the attaching type and from the recess type, each attaching element can be inserted in the same, above-described manner into a recess of the associated recess type. This insertion is intuitive, especially because it is obvious which attaching element matches which recess and which recess it does not match.

While specific embodiments of the invention have been shown and described in detail to illustrate the application of the principles of the invention, it will be understood that the invention may be embodied otherwise without departing from such principles.

LIST OF REFERENCE CHARACTERS

1 Arched helmet shell made of a hard material, to which the bearing structure 3, 4.*l*, 4.*r*, 5, 6, 8, 10 is attached

2 Arched shock-absorbing shell, inserted into the helmet shell 1 on the inside

3 Front holding ring part, connected to the helmet shell 1 by two screw connections 18.*l*, 18.*r*; it belongs to the outer component of the bearing structure; it forms a circular holding ring together with the rear holding ring part 5

4.*l* Left rear bearing ring part, connected to the front bearing ring part 6 in an articulated manner; it belongs to the inner component of the bearing structure

4.*r* Right rear bearing ring part, connected to the front bearing ring part 6 in an articulated manner; it belongs to the inner component of the bearing structure

5 Rear holding ring part, connected to the helmet shell 1 by the screw connections 13.*l* and 13.*r*; it belongs to the outer component of the bearing structure; it forms a circular holding ring together with the front holding ring part 3

6 Front bearing ring, connected to the two rear bearing ring parts 4.*l* and 4.*r*; it belongs to the inner component of the bearing structure; it forms a circular bearing ring together with the two rear bearing ring parts 4.*l* and 4.*r*

7 Visor, attached pivotably to the helmet shell 1 with two screw connections 20.*l*, 20.*r*

8 Bearing support for the back of the head, connected to the rear holding ring part 5; it belongs to the inner component of the bearing structure

9 Handwheel, with which a user changes the head size of the safety helmet 100

10 Centrally arranged rigid intermediate piece, which connects the front bearing ring part 6 to the front holding ring part 3

11.1, 11.2 Attaching element of the first attaching type; it can be received by a recess 14.1, 14.2, . . . of the first recess type

12.1, 12.2, . . . Attaching element of the second attaching type; it can be received by a recess 15.1, 15.2, . . . of the second recess type

13.*l*, 13.*r* Screw connection, with which the rear holding ring type 5 is attached to the helmet shell 1

14.1, 14.2 Recess of the first recess type; it is capable of receiving an attaching element 11.1, 11.2, . . . of the first attaching type

15.1, 15.2, . . . Recess of the second recess type; it is capable of receiving an attaching element 12.1, 12.2, . . . of the second attaching type

16.1, 16.2, . . . Recess of the third recess type; it is capable of receiving an attaching element 17.1, 17.2, . . . of the third attaching type

17.1, 17.2, . . . Attaching element of the second attaching type; it can be received by a recess 16.1, 16.2, . . . of the third recess type

18.1, 18.*r* Screw connections, with which the front holding ring part 3 is attached to the helmet shell 1

19.*l* Snap-in connection, which connects the left rear bearing ring part 4.*l* to the front holding ring part 3

19.*r* Snap-in connection, which connects the right rear bearing ring part 4.*r* to the front holding ring part 3

20.*l*, 20.*r* Screw connections, with which the visor 7 is attached to the front holding ring part 3

21 Upwards pointing projection at the front bearing ring part 6; it can be rotated in one embodiment about a horizontal rotation axis

22 Sunglasses in the form of an additional pivotable visor

23 Projection at the intermediate piece 10; it encloses the front holding ring part 3

24.*l* Pair of lateral projections at the front bearing ring part; they engage with corresponding recesses at the left rear bearing ring part 4.*l*

24.*r* Pair of lateral projections at the front bearing ring part 6; they engage with corresponding recesses at the rear bearing ring part 4.*r*

100 Safety helmet, comprising the helmet shell 1, the shock-absorbing shell 2, the visor 7, the holding ring parts 3 and 5, the bearing ring parts 4.*l*, 4.*r*, 6, the intermediate piece 10 and the handwheel 9 as well as an inner lining Bö Band opening of an attaching element 11.*x*, 12.*x*, 17.*x*

BR Viewing direction of a user of the safety helmet 100, who is looking straight forward DaA Roof section of an attaching element 11.*x*, 12.*x*; it projects over the trunk section StA Eö Insertion opening of a recess 14.*x*, 15.*x*, 16.*x*

HöHolding opening of a recess 14.*x*, 15.*x*, 16.*x*

Kö Attaching element body of an attaching element 11.*x*, 12.*x*, 17.*x*; it has a band opening Bö

St Web between the insertion opening EÖ and the holding opening HO

StA Trunk section of an attaching element 11.*x*, 12.*x*, 17.*x*; permanently connected to the attaching element body Kö; led through the holding opening HÖ when the connection has been established

What is claimed is:

1. A safety helmet comprising:

an arched helmet shell;

an inner lining, the safety helmet being configured such that the inner lining comes into contact with the head of a user of the safety helmet;

a bearing structure attached on an inside to the helmet shell and configured to carry the inner lining; and at least two connection units, wherein:

the safety helmet has at least two different connection types;

each of the connection units is configured to connect the inner lining detachably to the bearing structure;

each connection unit comprises:

a bearing structure-side component forming a part of the bearing structure and belonging to exactly one connection type of the at least two different connection types; and an inner lining-side component forming a part of the inner lining and belonging to exactly one connection type of the at least two different connection types;

the bearing structure-side component is connectable to the inner lining-side component to establish a detachable connection between the bearing structure and the inner lining if the bearing structure-side component belongs to the same connection type as the inner lining-side component; and the bearing structure-side component cannot be connected to the inner lining-side component or the two components are incapable of establishing a connection between the bearing structure and the inner lining if the bearing structure-side component and the inner lining-side component belong to different connection types.

2. The safety helmet in accordance with claim 1, wherein two inner lining-side components of two different connection types differ from one another in geometric shapes and/or at least one dimension and/or two bearing structure-side components of two different connection types differ from one another in geometric shapes and/or in at least one dimension, each of the two inner lining-side components having one portion located on one side of the bearing structure and another portion located on another side of the bearing structure.

3. The safety helmet in accordance with claim 1, wherein at least one connection unit provides a respective positive-locking connection, wherein the positive-locking connection comprises at least one of a snap-in connection, a snap connection, a button connection, and a snap fastener connection, each of the connection units being configured to detachably connect a textile component of the inner lining to the bearing structure, the inner lining-side component comprising an opening configured to receive a portion of the inner lining.

4. The safety helmet in accordance with claim 1, wherein:

the bearing structure-side component of at least one of the connection units comprises a recess; and the inner lining-side component of the connection units comprises a projection; or the inner lining-side component of at least another of the connection unit comprises a recess; or the bearing structure-side component of the connection unit comprises a projection; and each projection is inserted into a corresponding recess when the detachable connection has been established.

5. The safety helmet in accordance with claim 4, wherein:

the recess of one component of this connection unit comprises an insertion opening and the other component of this connection unit comprises a body, to which the projection is attached;

the projection is moveable through the insertion opening; and the projection is held in the recess when the connection has been established.

6. The safety helmet in accordance with claim 5, wherein:

the projection further comprises: a roof section and a trunk section arranged between the body and the roof section;

the recess further comprises a holding opening and a web between the insertion opening and the holding opening; and with the connection established, the trunk section passes through the holding opening and the web prevents a movement of the trunk section towards the insertion opening.

7. The safety helmet in accordance with claim 5, wherein:

the component with the recess comprises a holding element; and the holding element holds the projection, in a position moved through the insertion opening, with the connection has been established.

8. The safety helmet in accordance with claim 4, wherein at least one connection type has the feature that the bearing structure-side component comprises the recess and the inner lining-side component comprises the projection; and at least another connection type has the feature that the bearing structure-side component comprises the projection and the inner lining-side component comprises the recess.

9. The safety helmet in accordance with claim 1, wherein:

the bearing structure comprises an outer component permanently connected to the helmet shell and an inner component, which is configured to be in contact with the head of a user of the safety helmet;

a distance is formed between the outer component and the head of the user;

one portion of the inner lining-side component is located between the helmet shell and the bearing structure; and each bearing structure-side component is connected to the outer component.

10. A safety helmet comprising:

a helmet shell with a curved surface;

an inner lining configured to come into contact with the head of a user of the safety helmet, the inner lining comprising:

a first unit inner lining-side attaching component of a first connection unit, the first connection unit being configured to connect the inner lining detachably to the bearing structure, the first unit inner lining-side attaching component being configured as a first unit connection type that is one of a plurality of different connection types; and a second unit inner lining-side attaching component of a second connection unit, the second connection unit being configured to connect the inner lining detachably to the bearing structure, the second unit inner lining-side attaching component being configured as a second unit connection type that is one of the plurality of different connection types;

a bearing structure attached on an inside to the helmet shell and configured to carry the inner lining, the bearing structure comprising:

a first unit bearing structure-side attaching component of the first connection unit, the first unit bearing structure-side attaching component being configured as the first unit connection type; and a second unit bearing structure-side attaching component of the second connection unit, the second unit bearing structure-side attaching component being configured as the second unit connection type, wherein:

the first unit connection type and the second unit connection type are different such that the bearing structure-side attaching component is connectable to the inner lining-side attaching component to establish a detachable connection between the bearing structure and the inner lining if the bearing structure-side attaching component is of the same connection type and the bearing structure-side attaching component cannot be connected to the inner lining-side attaching component or the two attaching components are incapable of establishing a connection between the bearing structure and the inner lining if the connection types are different.

11. The safety helmet in accordance with claim 10, wherein the first unit connection type and the second unit connection type differ from one another in geometric shapes and/or at least one dimension, the first connection unit being configured to detachably connect a textile component of the inner lining to the bearing structure, the second connection unit being configured to detachably connect another textile component of the inner lining to the bearing structure, wherein a portion of the first unit inner lining-side attaching component is located between the bearing structure and the helmet shell, wherein a portion of the second unit inner lining-side attaching component is located between the bearing structure and the helmet shell, the portion of the first unit inner lining-side attaching component being located on one side of the bearing structure and another portion of the first unit inner lining-side attaching component being located on another side of the bearing structure, the portion of the second unit inner lining-side attaching component being located on the one side of the bearing structure and another portion of the second unit inner lining-side attaching component being located on the another side of the bearing structure.

12. The safety helmet in accordance with claim 10, wherein at least one of the first unit connection type and the second unit connection type provides a positive-locking connection, wherein the positive-locking connection comprises at least one of a snap-in connection, a snap connection, a button connection, and a snap fastener connection.

13. The safety helmet in accordance with claim 10, wherein:

one attaching component of the first connection unit comprises a recess; and another attaching component of the first connection unit comprises a projection;

one attaching component of the second connection unit comprises a recess;

another attaching component of the second connection unit comprises a projection; and each projection of the same connection unit is inserted into a corresponding recess with an established detachable connection.

14. The safety helmet in accordance with claim 13, wherein:

the recess of the first connection unit comprises an insertion opening and the other attaching component of the first connection unit further comprises a body, to which the projection of the first connection unit is attached;

the projection of the first connection unit is moveable through the insertion opening; and with the connection established the projection of the first connection unit is held in the recess of the first connection unit.

15. The safety helmet in accordance with claim 14, wherein:

the projection of the first connection unit further comprises: a roof section and a trunk section arranged between the body and the roof section;

the recess of the first connection unit further comprises a holding opening and a web between the insertion opening and the holding opening; and with the connection established, the trunk section passes through the holding opening and the web prevents a movement of the trunk section towards the insertion opening.

16. The safety helmet in accordance with claim 14, wherein:

the recess of the first connection unit further comprises a holding element; and the holding element holds the projection of the first connection unit, in a position moved through the insertion opening, with the connection established.

* * * * *